US006752714B1

(12) United States Patent
Mann

(10) Patent No.: US 6,752,714 B1
(45) Date of Patent: Jun. 22, 2004

(54) FIRE RESISTANT AIR TRANSFER GRILLE OR DAMPER

(75) Inventor: Robert McGowan Mann, Higher Ashton (GB)

(73) Assignee: Lorient Polyproducts Limited (GB)

( * ) Notice: Subject to any disclaimer, the term of this patent is extended or adjusted under 35 U.S.C. 154(b) by 0 days.

(21) Appl. No.: 10/089,275

(22) PCT Filed: Sep. 25, 2000

(86) PCT No.: PCT/GB00/03649

§ 371 (c)(1),
(2), (4) Date: Oct. 1, 2002

(87) PCT Pub. No.: WO01/21260

PCT Pub. Date: Mar. 29, 2001

(30) Foreign Application Priority Data

Sep. 24, 1999 (GB) ..... 9922500

(51) Int. Cl.[7] ..... F24F 13/08
(52) U.S. Cl. ..... 454/369; 454/257
(58) Field of Search ..... 454/257, 258, 454/342, 357, 369; 169/48

(56) References Cited

FOREIGN PATENT DOCUMENTS

| | | | | |
|---|---|---|---|---|
| FR | 2 254 182 | * 7/1975 | ..... 454/369 | |
| GB | 2 097 046 | * 10/1982 | | |
| GB | 2 159 051 | * 11/1985 | | |
| WO | WO 99/22107 | 5/1999 | ..... E06B/5/16 | |
| WO | 01/21260 | * 3/2003 | | |

* cited by examiner

*Primary Examiner*—Harold Joyce
(74) *Attorney, Agent, or Firm*—Paul F. Wille

(57) ABSTRACT

A fire resistant air transfer grille or damper (10), suitable for use as a ventilating means in fire resistant doors, walls and ventilation ducts, includes an outer frame (12) and a plurality of slats (14). Each of the slats (14) is provided with an intumescent core and is positioned in one of a number of predetermined positions within the outer frame (12). The predetermined positions are determined by a number of recesses (26) provided in the outer frame (12). The outer frame (12) may be formed as two separate frame components (16, 18), and is preferably made from steel. The slats (14) are preferably formed from aluminium with an intumescent material provided within the aluminium slat (14) to provide an intumescent core. Each of the slats (14) also preferably includes an elongate channel member (30, 32) along each of two of its side edges, wherein the elongate channel members (30, 32) of each of the slats (14) engage within the recesses (26) in the outer frame (12).

12 Claims, 4 Drawing Sheets

FIRE RESISTANT AIR TRANSFER GRILLE OR DAMPER

The invention relates to an improved fire resistant air transfer grille or damper, used particularly, but not exclusively, as ventilation means in fire and smoke resistant doors, walls and ventilation ducts.

Large buildings, especially industrial buildings, are often split into a number of self-contained areas by fire and smoke resistant walls and doors. It is often necessary to ventilate these areas, and hence a number of air transfer grilles or dampers are required to allow the through flow of air into and out of the self-contained areas.

However, in the event of a fire, these air transfer grilles or dampers also allow the through flow of smoke, hot gases and in extreme situations, flames.

It is thus desirable to use an air transfer grille or damper that does not allow the through flow of smoke, hot gases and flames in the event of a fire. Such an effective air transfer grille is one that incorporates a plurality of slats, wherein each of the slats has an intumescent core.

When used in fire and smoke resistant walls and doors defining a room or other distinct area, air transfer grilles or dampers incorporating intumescent slats allow the through flow of air in and out of the room.

In the event of a fire, high temperatures cause the intumescent slats to swell to many times their original thickness, fusing together to form a non-combustible mass which provides fire resistance to match the surrounding construction and prevent the through flow of hot gases, smoke and flames.

The intumescent slats may be provided with elongate reinforcing channels as protection along their edges. Hitherto the channels have been welded into position within an outer frame by spot welds, as shown in FIGS. 5–8. The use of spot welds in the manufacture of such grilles or dampers, however, is expensive due to the number of spot welds required, and the jigs required for each different size grille.

According to an aspect of the invention, there is provided a fire resistant air transfer grille or damper comprising:

a frame defining a gas transfer path, the frame including two opposed wall portions, each including at least one recess;

a slat including a core of intumescent material and having at least one elongate edge whereby the or a said edge is receivable at either end of the slat in a pair of the recesses respectively in the opposed wall portions; and a retainer for retaining the slat in the said recesses whereby the slat permits gas flow along the gas transfer path when unswollen and closes the gas transfer path on tumefaction.

An advantage of the invention is that spot welds are not required to secure the slat into position, as the slat is retained in position within recesses in the opposed wall portions of the frame by a retainer. This provides a much simpler method of assembly, and also provides a more robust product in use, as the risk of weld failure is removed.

In a preferred embodiment of the invention the retainer is a mirror image of the frame and so includes two opposed wall portions that each include at least one recess. In this preferred embodiment, the slat has a second elongate edge that is receivable at either end of the slat in a pair of the recesses respectively in the opposed wall portions of the retainer.

The frame and the retainer may be secured together by securing means, and are preferably secured together by a number of sleeve-bolts inserted through apertures in the retainer and the frame.

The use of sleeve-bolts prevents deformation of the frame components when the bolts are tightened.

An elongate channel member may be provided on the or each of the elongate edges of the slat. These elongate channel members protect the elongate edges of the slat that are receivable in recesses in the frame and, when required, in the retainer.

Preferably the elongate channel members are made from steel.

In a further embodiment of the invention, a plurality of slats each including a core of intumescent material and having at least one elongate edge are included within the fire resistant air transfer grille or damper. In this embodiment of the invention, the opposed walls of the frame each include a plurality of recesses and the or a said elongate edge of each of the plurality of slats is receivable at either end of the slat in a pair of recesses respectively on the opposed wall portions. The retainer retains the slats in the recesses, and in a preferred embodiment, the retainer is a mirror image of the frame and the slats each include a second elongate edge. The second edge of each of the plurality of slats is then receivable at either end of the slat in a pair of recesses respectively on opposed wall portions of the retainer.

In embodiments of the invention where the fire resistant air transfer grille or damper includes a plurality of slats, the or an elongate edge of each of the slats may be received at either end of the slat in a pair of recesses respectively so that the slats are arranged parallel to each other.

The frame and retainer may be rectangular in shape so producing a rectangular fire resistant air transfer grille or damper. The slat or slats may also be rectangular, each slat then having two elongate edges extending parallel to each other.

The slats may be made from PVC or metal with an intumescent material provided within the slat to provide an intumescent core.

Preferably the slats are made from aluminium with an intumescent material provided within the aluminium slat to provide an intumescent core.

The aluminium acts as a protective layer and gives a quick sealing response and added resistance to erosion of the intumescent material when subjected to high velocity hot gases.

In preferred embodiments, the outer frame is made from steel. Such an outer frame contributes to fire performance by preventing inward deformation of surrounding structures and protecting the intumescent material within the grille or damper.

The use of a fire resistant air transfer grille or damper according to a preferred embodiment of the invention has been found to provide fire resistance of up to four hours, and consistently achieve a complete seal in two minutes, when tested in accordance with BS 476 Parts 20 and 22, and similarly internationally recognised standard methods of test. In some circumstances a complete seal is achieved in as little as ninety seconds.

An embodiment of the invention has also been found to be resistant to the onerous impact, erosion and cooling effects of the "Hose Stream" test applied after exposure to typical American fire test regimes such as UL 10C.

According to a further aspect of the invention there is provided a method of manufacturing a fire resistant air transfer grille or damper including the steps of:

positioning a slat including a core of intumescent material and having at least one elongate edge, so that the or a said edge is received at either end of the slat in a pair of recesses respectively in opposed wall portions of a frame; and positioning a retainer so that it retains the slat in the said recesses.

An example of a fire resistant air transfer grille or damper according to an embodiment of the invention will now be described, by way of a non-limiting example, with reference to the following figures in which.

Figure 1:
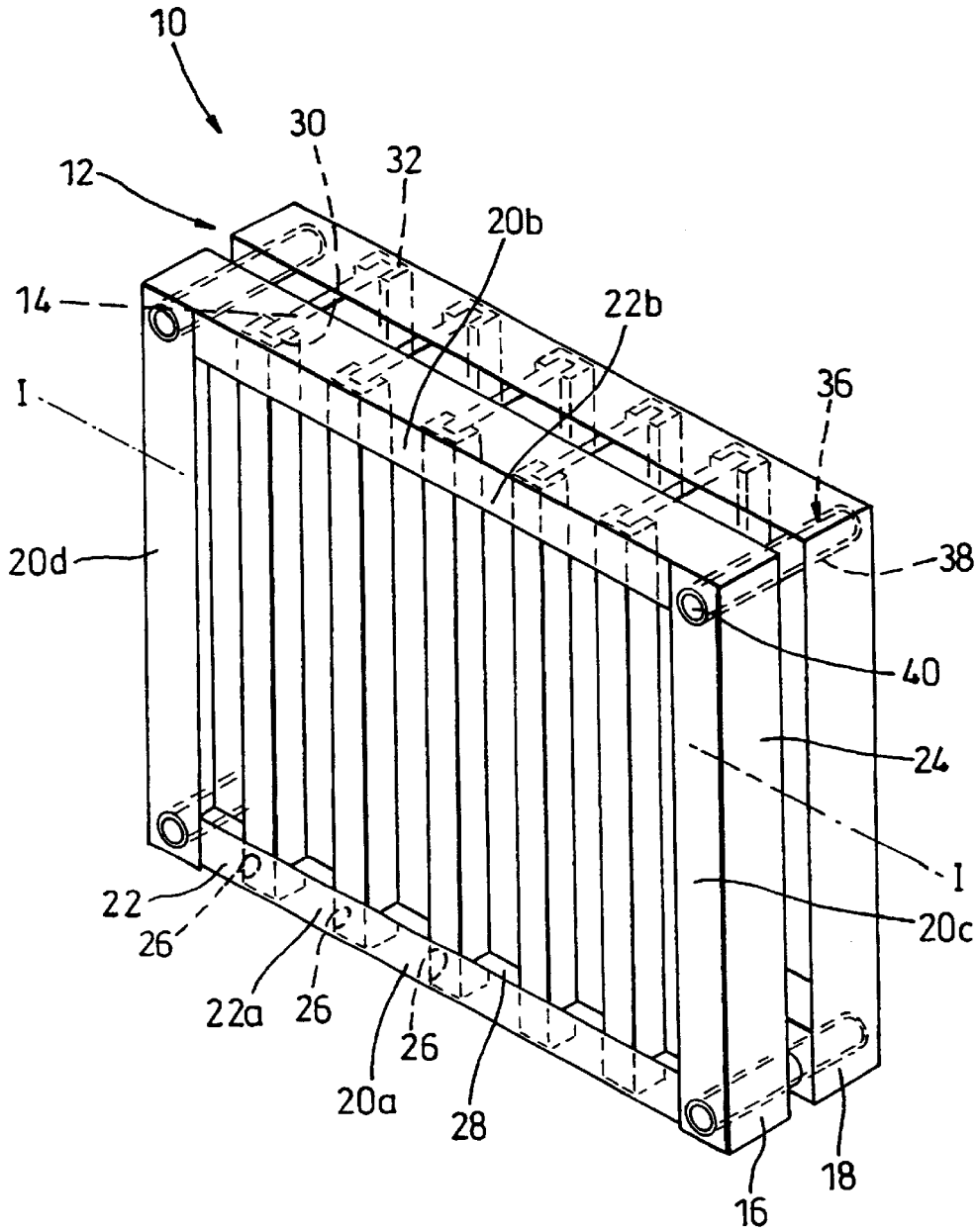
FIG. 1 is a perspective view of a fire resistant air transfer grille or damper according to an embodiment of the invention.
Figure 4:
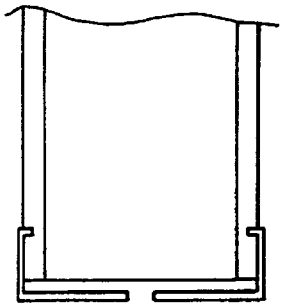
FIGS. 3 and 4 show parts of the FIG. 2 arrangement in more detail.
Figure 3:
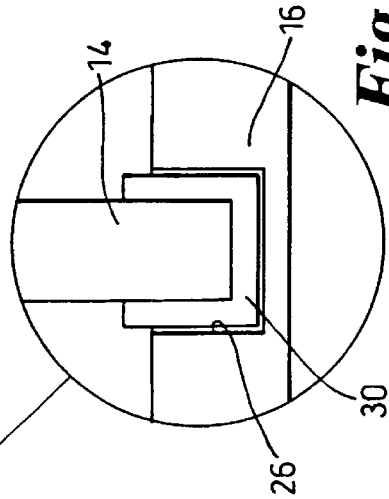
Figure 2:
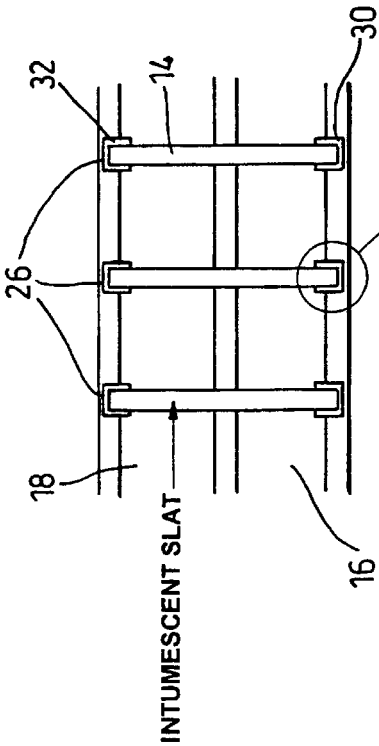
FIG. 2 shows the air transfer grille or damper of FIG. 1 along the line I—I.
Figure 5:
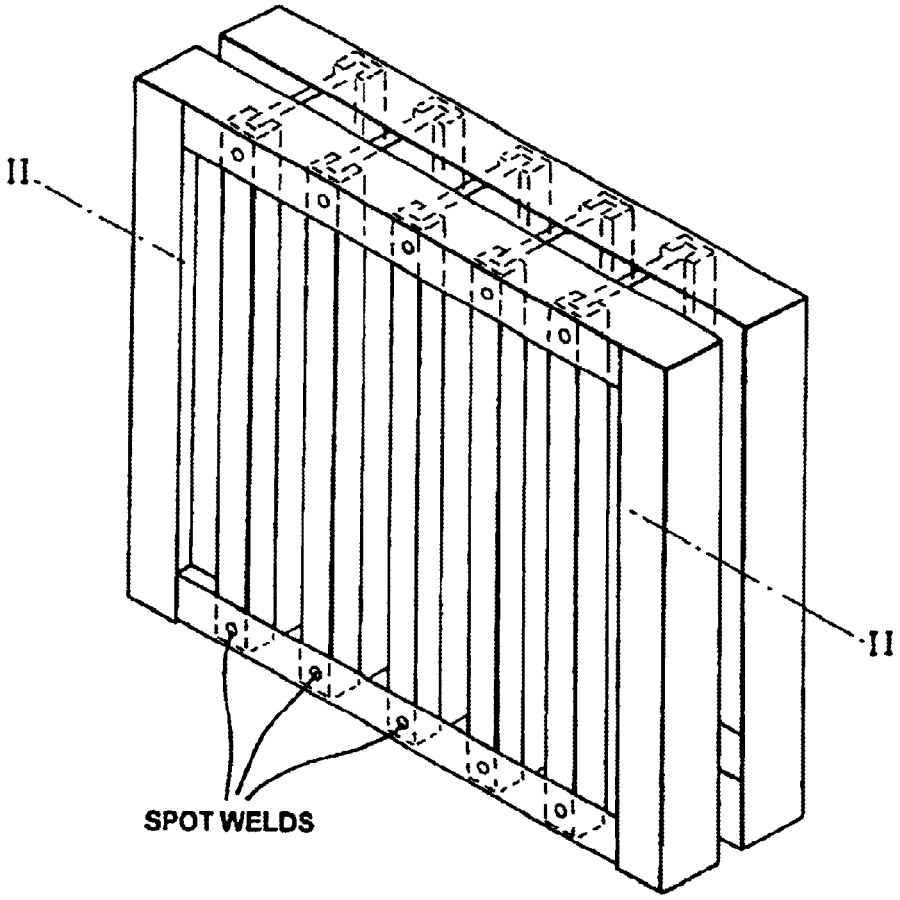
Fig. 5 (Prior Art)
FIG. 5 is a perspective view of a prior art fire resistant air transfer grille or damper including a plurality of slats secured into position by spot welds.
Figure 7:
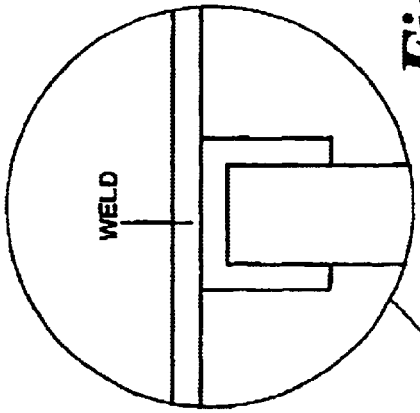
Fig. 7 (Prior Art)
FIGS. 7 and 8 show parts of the FIG. 6 arrangement in more detail.
Figure 8:
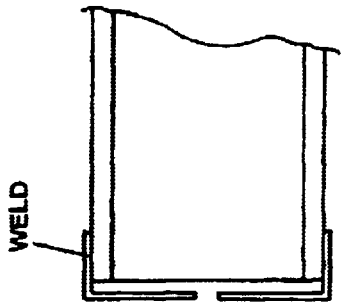
Fig. 8 (Prior Art)
Figure 6:
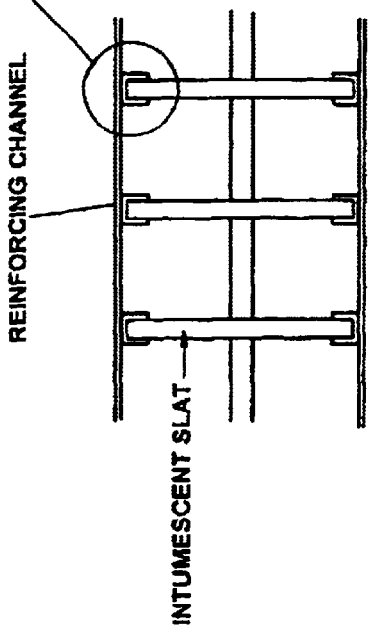
Fig. 6 (Prior Art)
FIG. 6 shows the fire resistant air transfer grille or damper of FIG. 5 along the line II—II.

A fire resistant air transfer grille or damper 10 (herein "air transfer grille 10") according to an embodiment of the invention is shown in FIG. 1.

The air transfer grille 10 includes an outer frame 12 and a plurality of slats 14 positioned at predetermined positions within the outer frame 12.

Either side of the outer frame 12 is open, so that in use, air can pass between the slats 14 in the grille 10.

The air transfer grille 10 shown in FIG. 1 is rectangular, but it will readily become obvious to a skilled reader how, within the scope of the invention, to produce an air transfer grille 10 of other shapes.

The outer frame 12 of the air transfer grille 10 is made up of two identically shaped and dimensioned frame components 16,18.

Each of the frame components is formed from four generally L-shaped frame members 20*a*–20*d* that are preferably welded together.

In other embodiments, the four generally L-shaped frame members 20*a*–20*d* may be mechanically fastened together.

Due to the nature of the generally L-shaped frame members 20*a*–20*d*, each of the frame components 16,18 has a front edge 22 that extends around the perimeter of the frame component, and a side edge 24 that extends away from, and perpendicular to, the front edge 22.

The front edge 22 of each of the frame components 16,18 surrounds the opening through which, in use, air flows through the air transfer grille 10.

Two parallel sides 22*a*,22*b* of the front edge 22 are provided with a plurality of equidistantly spaced recesses 26. The recesses 26 in this embodiment are formed in a lip 28 that is upstanding an inner edge of the front edge 22 on the two sides 22*a*,22*b*.

Pairs of the recesses 26 on each of the parallel sides 22*a*,22*b* are aligned with each other.

The slats 14 that are used in the air transfer grille 10 shown in FIG. 1 each take the form of a rectangular strip. The shape of the slats 14 is dependent upon the shape of the outer frame 12 of the air transfer grille 10.

The slats 14 preferably include an aluminium membrane surrounding an intumescent material to provide each of the slats 14 with an intumescent core.

In other embodiments, the slats 14 may include a copper membrane.

The slats 14 shown in FIGS. 1 to 4 each include two elongate retainers or channel members 30,32, that extend along two parallel sides 34,36 of each of the slats 14 respectively.

In a preferred embodiment of the invention, the elongate channel members 30,32 and the outer frame 12 of the air transfer grille 10 are made from steel.

To construct the air transfer grille 10, the slats 14 are positioned so that one (30) of each of the elongate channel members 30,32 of each of the slats 14 extends between, and engages within, two corresponding recesses 26 of one (16) of the frame components 16,18.

The slats 14 extend generally perpendicular to the frame component 16 so that the other elongate channel member 32 of each of the slats 14 can extend between, and engage within, two corresponding recesses 26 in the other frame component 18.

In use, the two frame components 16,18 are secured together, in an opposite orientation to each other, so that the side edges 24 of each of the frame components 16,18 meet each other, and the front edges 22 are on the outside of the completed air transfer grille 10.

The two frame components 16,18 are preferably secured together by four sleeve-bolts 36, each sleeve-bolt passing from an aperture in one of the corners of the front edge 22 of one (16) of the frame components 16,18, to an aperture in the corresponding corner of the front edge 22 of the other frame component 18.

The sleeve 38 of each of the sleeve-bolts 36 extends between the front edges 22 of the two frame components 16,18 so that over-tightening of the bolt 40 is prevented, and the front edges 22 of the frame components 16,18 do not become distorted.

What is claimed is:

1. A fire resistant air transfer grille or damper, comprising:

a frame defining a gas transfer path and a plurality of slats extending across the path, the frame being formed by a frame component and a retainer which are secured together, the frame component including two opposed wall portions each including a plurality of recesses;

each slat including a core of intumescent material and having at least one elongate edge, whereby the edge of a slat is receivable at either end of the slat in a pair of the recesses respectively in the opposed wall portions; and securing means for securing the frame component and retainer together in order to retain each slat in the said recesses, whereby the slats permit gas flow along the gas transfer path when unswollen and close the gas transfer path on tumefaction.

2. A fire resistant air transfer grille or damper according to claim 1 wherein each opposed wall portion comprises an L-shaped frame member having a lip in which said recesses are formed.

3. A fire resistant air transfer grille or damper according to claim 1, wherein the retainer includes two opposed wall portions that each include a plurality of recesses, each slat having a second elongate edge that engages within a pair of recesses in the retainer when the retainer retains each slat in the recesses in the frame component.

4. A fire resistant air transfer grille or damper according to claim 1, wherein the securing means comprise a number of sleeve-bolts inserted through apertures in the retainer and the frame component.

5. A fire resistant air transfer grille or damper according to claim 1 wherein a retainer is provided on each of the elongate edges of each slat.

6. A fire resistant air transfer grille or damper according to claim 1, wherein the slats are arranged parallel to each other.

7. A fire resistant air transfer grille or damper according to claim 1, wherein the frame component and retainer are rectangular in shape, producing a rectangular air transfer grille.

8. A fire resistant air transfer grille or damper according to claim 1, wherein each slat is made from one of PVC or metal, with an intumescent material provided within the slat to provide an intumescent core.

9. A fire resistant air grille or damper according to claim 8, wherein each slat is made from aluminium with an intumescent material provided within the aluminium slat to provide an intumescent core.

10. A fire resistant air transfer grille or damper according claim 1, wherein each slat is rectangular and is provided with two parallel elongate edges.

11. A method of manufacturing a fire resistant air transfer grille or damper in accordance with claim 1, including the steps of:

positioning a plurality of slats each including a core of intumescent material and having at least one elongate edge, so that the edge of each slat is received at either end of the slat in a pair of recesses respectively in opposed wall portions of a frame component;

positioning a retainer so that it retains the slat in the said recesses and securing the frame component and retainer together using securing means.

12. A method of manufacturing a fire resistant air transfer grille or damper according to claim 11, including the step of positioning the retainer so that the second edge of each slat is received at either end of the slat in a pair of recesses respectively in opposed wall portions of the retainer so that the retainer retains each slat in the said recesses of the frame component.

* * * * *